US007220905B2

(12) United States Patent
Takegawa

(10) Patent No.: US 7,220,905 B2
(45) Date of Patent: May 22, 2007

(54) STRAINER FOR A SNARE DRUM

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 126 days.

(21) Appl. No.: 11/090,845

(22) Filed: Mar. 25, 2005

(65) Prior Publication Data

US 2006/0213352 A1 Sep. 28, 2006

(51) Int. Cl.
*G10D 13/02* (2006.01)

(52) U.S. Cl. ..... 84/415

(58) Field of Classification Search ..... 84/415, 84/417

See application file for complete search history.

(56) References Cited

U.S. PATENT DOCUMENTS 5,684,257 A 11/1997 Yanagisawa
6,020,547 A * 2/2000 Chen ..... 84/415
2005/0188818 A1* 9/2005 Okamoto ..... 84/415

* cited by examiner

*Primary Examiner*—Kimberly Lockett
(74) *Attorney, Agent, or Firm*—Berenato, White & Stavish

(57) ABSTRACT

A strainer for a snare assembly adapted to be attached to a percussion instrument, comprising a tensioning mechanism for applying a tension to snares of a percussion instrument; a lever having a first end and a second end, the lever being pivotably mounted to the tensioning mechanism, whereby pivoting the lever changes a position of the tensioning mechanism to change the tension in the snares; and a positive locking mechanism to positively lock said lever in at least one of a plurality of snare tensioning positions. The positive lock mechanism mechanically connects the lever to a body portion fixedly mounted to the percussion instrument. In the preferred embodiment, the positive locking mechanism comprises a movable button that is movable relative to the lever to change the positive locking mechanism to an unlocking condition where the lever is free to pivot with respect to the body portion.

15 Claims, 2 Drawing Sheets

Fig. 5
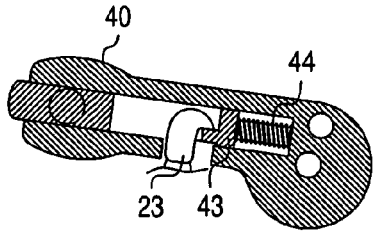
Fig. 6
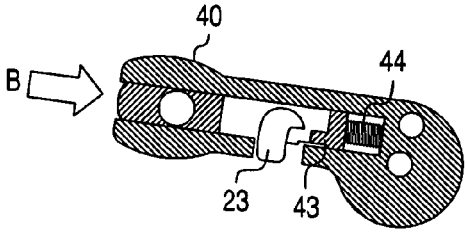
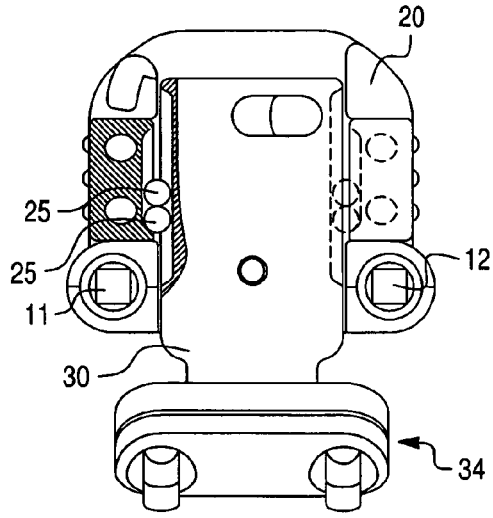
Fig. 4
Fig. 8
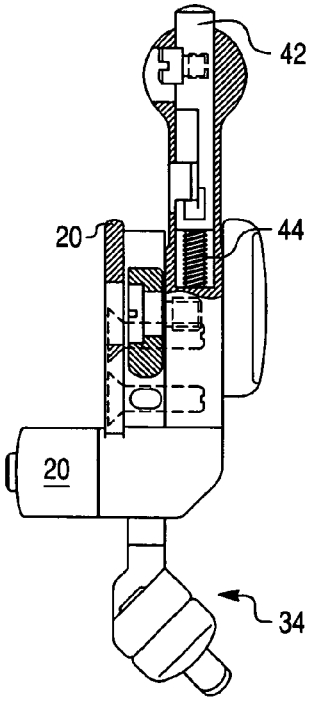
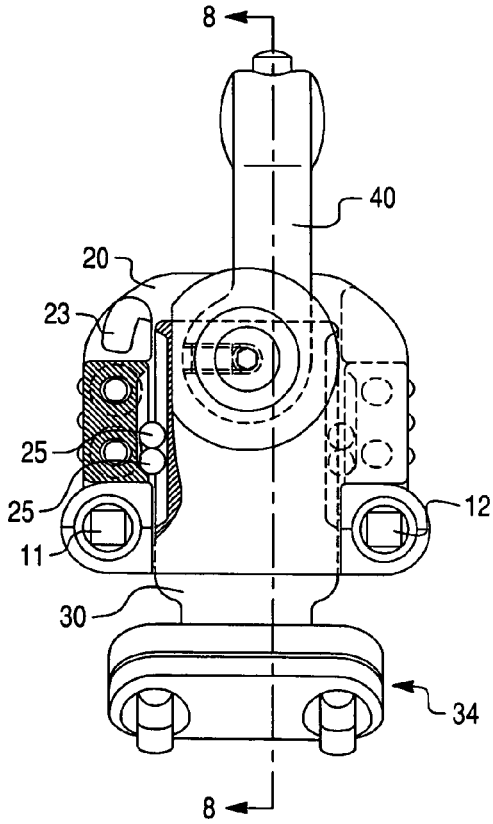
Fig. 7

STRAINER FOR A SNARE DRUM

BACKGROUND OF THE INVENTION

1. Field of the Invention

The present invention is directed to a strainer for use with a drum, in particular to a strainer for use with a snare drum, where the strainer includes a positive locking mechanism.

2. Description of the Related Art

Snare drums typically include a plurality of wires, or snares, which contact a bottom drumhead of the snare drum so that the snares are vibrated by the vibration of the bottom drumhead when the snare drum is played. A strainer is typically used to tension the snares in order to change the tone produced by the drum by changing the position of the snares so that they are either in contact or not in contact with the drumhead. Snare tension may also be fine tuned or finely adjusted by a tension knob which is rotated to finely tune the tension in the snare to change the tone produced by the drum.

Conventional strainers for snares use a lever directly connected to a piston, wherein the lever pivots about an axis generally perpendicular to the piston, so that when the lever is pivoted from one position to another, the piston drops and the tension in the snares is released so that the snares are no longer in contact with the drumhead. Some of these pivoting lever for strainers can only be operated so that the snares are either in contact with the drumhead (snares-on mode), or not in contact with the drumhead (snares-off mode), and are not adjustable to different tensions in between. Further, the strainer tends to be tensioned or released quickly, so that the snares make an unwanted "throw-off" noise against the drumhead, which is very undesirable, particularly for orchestral musicians. Other prior art systems permit intermediate adjustment of the snare tension between the snare-on and snare-off modes using the strainer.

However, strainer levers of the prior art systems may become accidentally dislodged because they do not have any positive lock mechanism; therefore, the levers can accidentally vibrate loose and disengage to the off position during vigorous play.

The need exists for a system and assembly for positively locking the strainer lever and/or tension knob to prevent slippage or disengagement during performance or play.

SUMMARY OF THE INVENTION

A strainer for a snare assembly is adapted to be attached to a percussion instrument, the strainer comprising a tensioning mechanism for applying a tension to snares of a percussion instrument; a lever having a first end and a second end, the lever being pivotably mounted to the tensioning mechanism, whereby pivoting the lever changes a position of the tensioning mechanism to change the tension in the snares; and a positive locking mechanism to positively lock said lever in at least one of a plurality of snare tensioning positions. The positive lock mechanism mechanically connects the lever to a body portion fixedly mounted to the percussion instrument.

In the preferred embodiment, the positive locking mechanism comprises a movable button that is movable relative to the lever to change the positive locking mechanism from a locking condition where the lever is blocked against pivotal rotation relative to said body portion to an unlocking condition where the lever is free to pivot with respect to the body portion.

The invention may employ a hook-style latch disposed on the main body portion fixed to the drum shell and a locking pawl disposed on the movable button, whereby the locking pawl selectively mates with the hook-style latch to achieve the locking condition. When an operator pushes the movable button, the locking pawl is disengaged from the hook-style latch. Of course, the invention should not be limited to the specific structure shown in the drawings or described herein.

The structural and functional benefits of the present invention will be apparent to those of skill in the art when viewed in light of the following description and the accompanying drawings, which are not intended to limit the scope of the invention.

BRIEF DESCRIPTION OF THE DRAWINGS

FIG. 4 is a partial cross sectional view of the strainer of FIGS. 2 and 3 showing the internal piston member and bearing system.

FIG. 5 is a cross sectional view of the lever and positive lever locking mechanism sown in FIGS. 2 and 3 shown in the locked position.

FIG. 6 is a cross sectional view of the lever and positive lever locking mechanism sown in FIGS. 2 and 3 shown in the unlocked position.

FIG. 7 is a partial cross sectional view of the strainer of the present invention.

FIG. 8 is a partial cross sectional view of the strainer of FIG. 7 taken along section line VIII-VIII.

DETAILED DESCRIPTION OF PREFERRED EMBODIMENT

Figure 1:
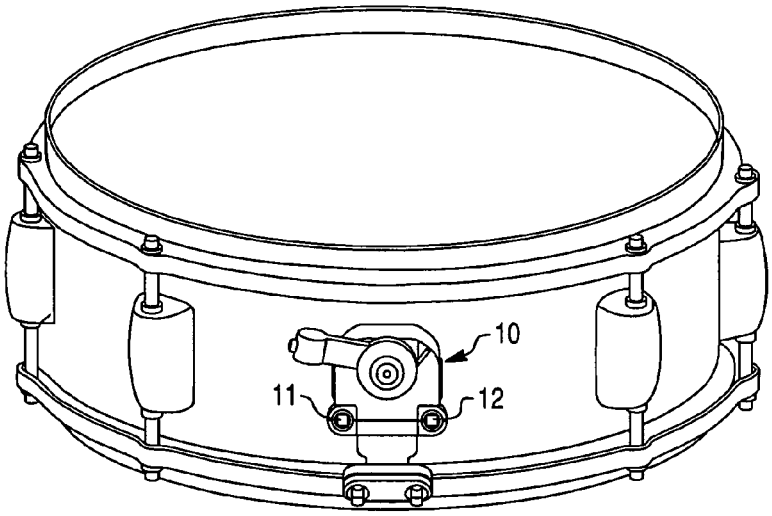
FIG. 1 is a perspective view of the snare drum and strainer assembly of this present invention.

With reference to FIG. 1, the strainer 10 of this invention is shown mounted to docking stations (not shown) bolted to the drum shell. Attachment bolts 11, 12 preferably have a drum key head thus making the strainer 10 easy to remove with a conventional drum key with the strings and snares still attached to the strainer 10. This allows the bottom head of the drum to be changed without altering the setting of the snares. After the bottom head of the drum is replaced, the strainer 10, also referred to as a throw-off, can be reattached to the drum and the snares will be perfectly set and aligned as before removal.

Figure 2:
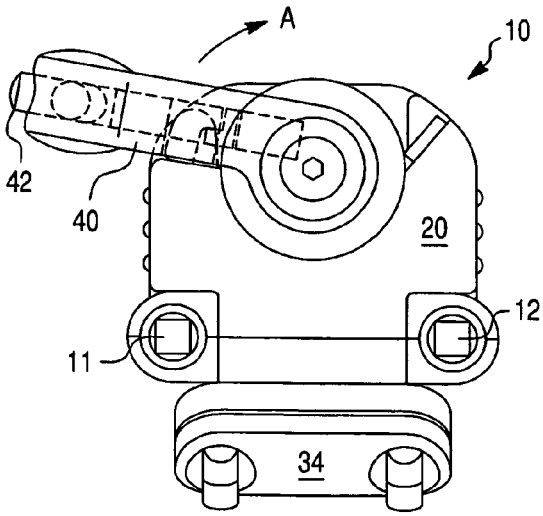
FIG. 2 is a front view of the strainer according to the present invention shown in the snare-on position.
Figure 3:
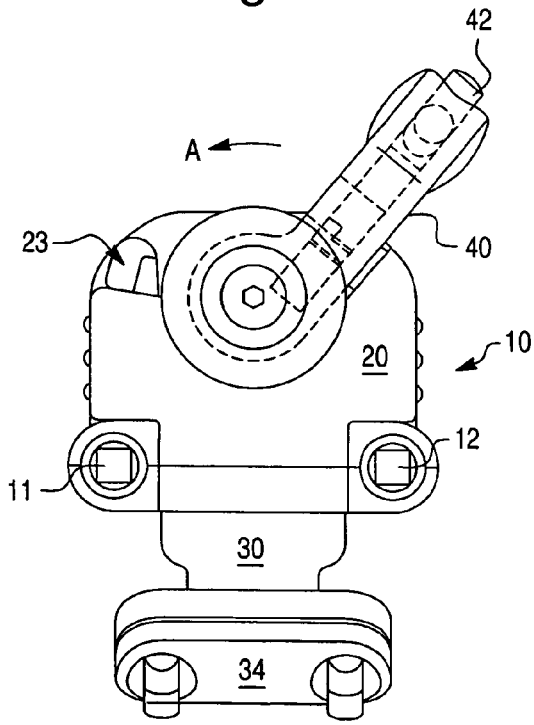
FIG. 3 is a front view of the strainer according to the present invention shown in the snare-off position.

The strainer 10 is shown in an isolated drawing in FIGS. 2 and 3. FIG. 2 shows the strainer 10 in a snare-on position, and FIG. 3 shows the strainer 10 in the snare-off position. The strainer 10 comprises a main body 20 mountable to the drum shell through attachment bolts 11, 12; a piston member 30 sandwiched between two shell members of the main body 20; and a lever 40 that is cammingly engageable with the piston member 30. Thus, the piston 30 is retained within the main body 20 connected to the shell so that the piston member 30 may reciprocate relative to the shell. As the lever 40 is pivoted in the direction of arrow 'A' shown in FIG. 2, the piston member 30 will move in a downward direction and, as a result, the snare clamp 34 moves to adjust the tension on the snares.

Typically, snares are operably connected to piston member 30 by the snare clamp 34 in a manner that is well known to those of skill in the art.

FIG. 4 shows the piston member 30 and main body 20 with bearing members 25 in the form of steel balls disposed between the main body 20 and the piston member 30. Although two such ball bearing members 25 are shown on each side of the piston member 30, it may be preferable to include a different number of these bearing members 25; it has been shown that two bearing members 25 may be a preferred design. Additionally, a low-friction bearing plate may be used in the places of the ball bearing member 25. The low-friction bearing plates or bearing members 25 reduce side-by-play of the piston member 30 and provide a smoother camming action during use.

With reference to FIGS. 5-6, the present invention further provides a positive lever locking mechanism. Specifically, the lever 40 is assembled with a push-button release member 42 that is spring biased by a resilient member 44. The positive lever locking mechanism is provided by a hook-type latch 23 fixedly mounted on the main body 20 and the sliding pawl 43 of the release member 42.

When the positive lever locking mechanism is in the lock position shown in FIG. 5, the lever cannot pivot in the direction of arrow A' shown in FIG. 3 because the hook-type latch 23 is locked with the sliding pawl 43 of the release member 42. When the release member 42 is depressed in the direction of arrow 'B' then the hook-type latch 23 is released from the sliding pawl 43 and the lever may be pivoted from the snare-on position (FIG. 2) to the snare-off position (FIG. 3).

The attached drawings show the preferred assembly for providing a positive locking mechanism. It is of course envisioned that the hook-type latch and pawl assembly shown in the drawings may be replaced by other mechanical locking system that prevent the snare tension from being accidentally or improperly disengaged or loosened during use by a performer. Likewise, it will be understood by those of skill in the art that other changes in form and detail may be made to the preferred embodiments described herein without departing from the spirit and scope of this invention. For example, the positive locking system of this invention could positively lock the tension of the snares separate and apart from the lever 40. In other words, the locking system may be disposed on at a different location on the strainer apart from the lever 40; for example, the locking system could positively lock the piston 30 to the main body portion.

The invention claimed is:

1. A strainer for a snare assembly adapted to be attached to a percussion instrument, said strainer comprising:

a tensioning mechanism for applying a tension to snares of a percussion instrument;

a lever pivotably mounted with respect to said tensioning mechanism, whereby pivoting said lever changes a position of said tensioning mechanism to change said tension in said snares;

a positive locking mechanism to positively lock said lever in at least one of a plurality of snare tensioning positions, wherein said positive lock mechanism mechanically connects the lever to a body portion fixedly mounted to the percussion instruments, wherein said tensioning mechanism comprises a piston movably disposed on said body portion, said piston being moved by a camming action during movement of said lever.

2. The strainer recited in claim 1, wherein said positive locking mechanism comprises a movable member that is movable relative to said lever to change said positive locking mechanism from a locking condition where said lever is blocked against pivotal rotation relative to said body portion to an unlocking condition where said lever is free to pivot with respect to said body portion.

3. The strainer recited in claim 2, wherein said movable member is disposed on said lever.

4. The strainer recited in claim 2, wherein said movable member is disposed on said body portion.

5. The strainer for a snare assembly adapted to be attached to a percussion instrument, said strainer comprising:

a tensioning mechanism for applying a tension to snares of a percussion instrument;

a lever pivotably mounted with respect to said tensioning mechanism, whereby pivoting said lever changes a position of said tensioning mechanism to change said tension in said snares;

a positive locking mechanism to positively lock said lever in at least one of a plurality of snare tensioning positions, wherein said positive lock mechanism mechanically connects the lever to a body portion fixedly mounted to the percussion instrument, wherein said movable member is biased into said locking position by a resilient member.

6. The strainer recited in claim 5, wherein said resilient member is disposed on said lever.

7. The strainer recited in claim 1, wherein said positive locking mechanism locks said lever in a single snare tensioning position.

8. The strainer recited in claim 1, wherein said positive locking mechanism comprises a hook-style latch mounted on the body portion.

9. The strainer for a snare assembly adapted to be attached to a percussion instrument, said strainer comprising:

a tensioning mechanism for applying a tension to snares of a percussion instrument;

a lever pivotably mounted with respect to said tensioning mechanism, whereby pivoting said lever changes a position of said tensioning mechanism to change said tension in said snares;

a positive locking mechanism to positively lock said lever in at least one of a plurality of snare tensioning positions, wherein said positive lock mechanism mechanically connects the lever to a body portion fixedly mounted to the percussion instrument, wherein said positive locking mechanism further comprises a movable pawl disposed on the lever, said pawl selectively engaging the hook-style latch.

10. The strainer for a snare assembly adapted to be attached to a percussion instrument, said strainer comprising:

a tensioning mechanism for applying a tension to snares of a percussion instrument;

a lever pivotably mounted with respect to said tensioning mechanism, whereby pivoting said lever changes a position of said tensioning mechanism to change said tension in said snares;

a positive locking mechanism to positively lock said lever in at least one of a plurality of snare tensioning positions, wherein said positive lock mechanism mechanically connects the lever to a body portion fixedly mounted to the percussion instrument, wherein said positive locking mechanism further comprises a button disposed on said lever, said button being selectively movable to permit movement of said lever to change said tension in said snares.

11. The strainer recited in claim 10, wherein said button is slidingly disposed on said lever.

12. The strainer recited in claim 10, wherein said button is biased into a locking position by a resilient member disposed on said lever.

13. A positive locking system for a strainer for a snare assembly, said locking mechanism comprising:

a tensioning mechanism for adjusting tension to snares of a percussion instrument, whereby movement of said tensioning mechanism changes said tension in said snares;

a locking mechanism to positively lock said tensioning mechanism in at least one of a plurality of snare tensioning positions, wherein said positive lock mechanism mechanically connects the tensioning mechanism to a body portion fixedly mounted to the percussion instruments, wherein said latch selectively connects at least one of a pivoting lever and a sliding piston of said strainer to said body portion, wherein pivotal movement of said lever causes sliding movement of said piston.

14. The positive locking system recited in claim 13, wherein said locking mechanism comprises a selectively releasable latch that is movable to change said locking mechanism from a locking condition where said tensioning mechanism is blocked against pivotal rotation relative to said body portion to an unlocking condition where said tensioning mechanism is free to pivot with respect to said body portion.

15. The positive lock system recited in claim 14, wherein said latch is released by actuation of a spring-biased button.

* * * * *